US009216608B1

(12) United States Patent
Nelson et al.

(10) Patent No.: US 9,216,608 B1
(45) Date of Patent: Dec. 22, 2015

(54) INTERACTIVE GREETING CARD WITH ARTICULATED CHARACTER

(71) Applicant: American Greetings Corporation, Cleveland, OH (US)

(72) Inventors: Gary Nelson, Avon, OH (US); Melissa Flesher, Avon, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 14/708,359

(22) Filed: May 11, 2015

(51) Int. Cl.
*B42D 15/02* (2006.01)
*B42D 15/04* (2006.01)
*A63H 3/18* (2006.01)

(52) U.S. Cl.
CPC ..... *B42D 15/045* (2013.01); *A63H 3/18* (2013.01); *B42D 15/022* (2013.01); *B42D 15/027* (2013.01); *B42D 15/042* (2013.01)

(58) Field of Classification Search
CPC ..... B42D 15/027; A63H 3/18
See application file for complete search history.

(56) References Cited

U.S. PATENT DOCUMENTS

| | | | | | |
|---|---|---|---|---|---|
| 436,455 | A * | 9/1890 | Crandall | 446/331 |
| 2,453,646 | A * | 11/1948 | Tomlin et al. | 446/331 |
| 2,455,430 | A * | 12/1948 | Luckhaupt | 446/331 |
| 2,463,355 | A * | 3/1949 | Buchmann | 446/331 |
| 3,358,401 | A * | 12/1967 | Graf | 446/331 |
| 3,427,642 | A * | 2/1969 | Mohr | 40/124.08 |
| 3,486,270 | A * | 12/1969 | Maher | 446/152 |
| 3,981,097 | A * | 9/1976 | Bunin | 446/363 |
| 4,412,399 | A * | 11/1983 | Abe et al. | 446/359 |
| 4,591,345 | A * | 5/1986 | Kohner | 446/361 |
| 4,840,275 | A * | 6/1989 | Faiola et al. | 206/423 |
| 4,870,764 | A * | 10/1989 | Boone | 40/124.06 |
| 4,951,404 | A * | 8/1990 | Lithwick | 40/124.06 |
| 6,076,675 | A * | 6/2000 | Pawlowski | 206/459.5 |
| 8,955,240 | B1 * | 2/2015 | Loftus et al. | 40/124.03 |
| 2011/0078931 | A1 * | 4/2011 | Sapp et al. | 40/124.03 |

* cited by examiner

*Primary Examiner* — Gary Hoge
(74) *Attorney, Agent, or Firm* — Christine Flanagan

(57) ABSTRACT

A greeting card having a jointed or articulated character attached to a surface thereof, the articulated character being movable by user interaction with the greeting card. The articulated character contains various segments which are attached together at various pivot or hinge points making the character capable of bending and moving various aspects of the character body in various ways or directions which simulate the character dancing to audio playing in the background.

20 Claims, 3 Drawing Sheets

INTERACTIVE GREETING CARD WITH ARTICULATED CHARACTER

RELATED APPLICATIONS

There are no applications related to this application.

FIELD OF THE INVENTION

This application is in the field of greeting cards and social expression products. More specifically, the invention is directed to a greeting card having a user manipulated dancing character.

SUMMARY OF THE INVENTION

A greeting card having a jointed or articulated character attached to a surface thereof, the articulated character being movable by user interaction with the greeting card. The articulated character contains various segments which are attached together at various pivot or hinge points making the character capable of bending and moving various aspects of the character body in various ways or directions which simulate the character dancing to audio playing in the background.

DETAILED DESCRIPTION OF PREFERRED AND ALTERNATE EMBODIMENTS

The greeting card of the present disclosure and related inventions contains a greeting card 100 with a jointed or articulated character 10 attached to or contained within the greeting card 100. A push button 12 allows a user to manipulate or move the character 10 in different ways by continuously pressing the push button 12 while music or other audio plays in the background.

Figure 1:
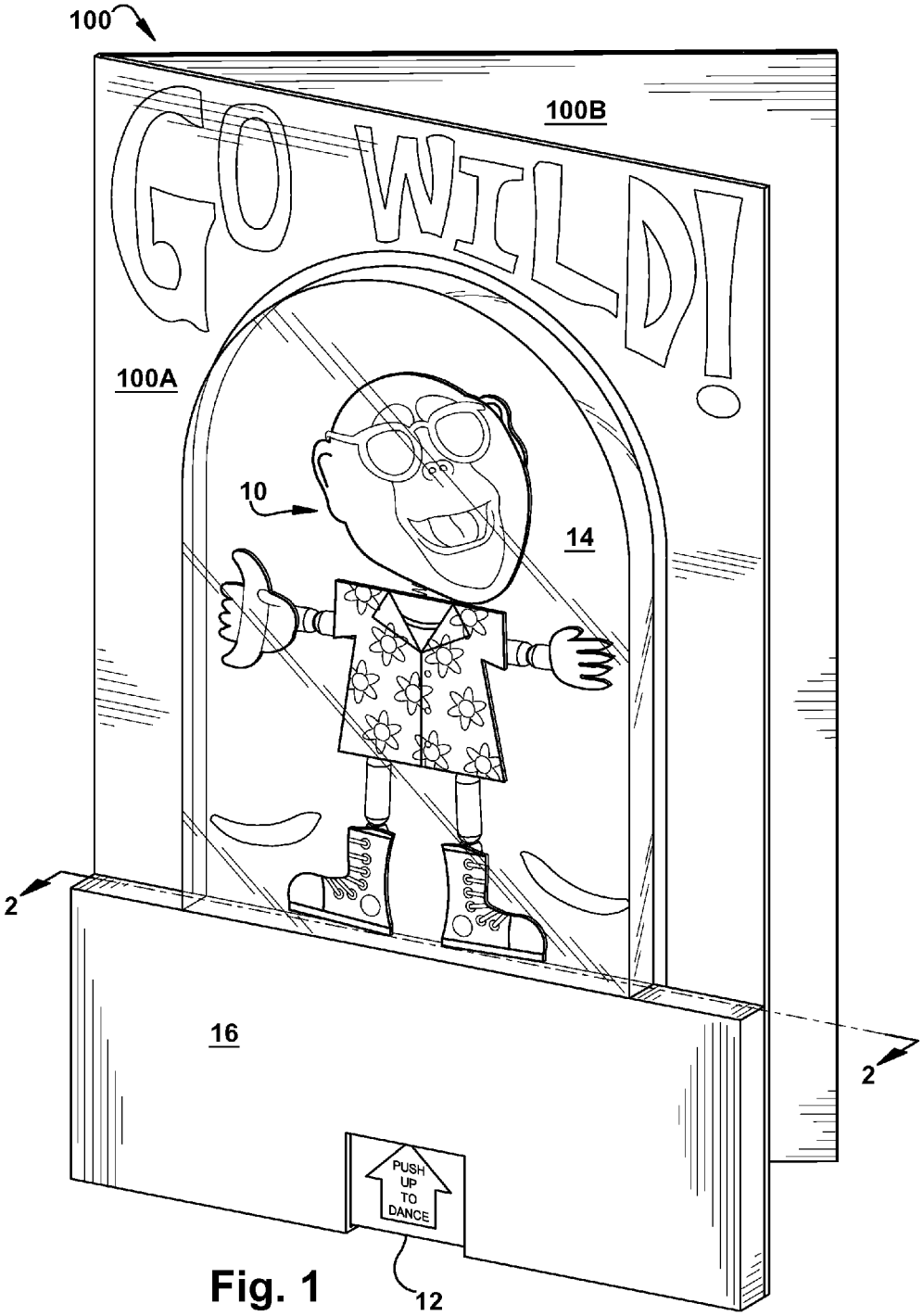
FIG. 1 is a perspective view of the greeting card of the present invention.

The greeting card body contains at least two greeting card panels 100A, 100B connected along at least one fold line. The at least two panels 100A, 100B are folded along the fold line to create a traditional two-panel greeting card having a front cover, an inside left panel, an inside right panel, and a back cover. The greeting card 100 is opened and closed by pivoting the front cover 100A about the at least one fold line away from and towards the back cover 100B of the greeting card 100. Each of the front cover, inside left and right panels and back cover may contain printing thereon which may include, but is not limited to text sentiment or greetings, photographs, drawings, pictures, artwork or other printed indicia. The greeting card 100 may additionally be embellished with other decorative effects such as googly eyes, gems, fur, or other three-dimensional adornments. In a preferred embodiment, the front cover 100A of the greeting card contains a transparent enclosed cavity or compartment 14. The enclosed cavity or compartment 14 may be made of a transparent moulded plastic having a planar front surface and a perimeter surface which extends between the front surface and the front cover 100A of the greeting card 100. In a preferred embodiment, the enclosed cavity or compartment 14 contains a straight or linear horizontal bottom perimeter surface with substantially linear side (right and left) surfaces extending vertically upward from the linear horizontal bottom perimeter surface and transitioning into an arched upper or top perimeter surface of the enclosed cavity or compartment 30. The cavity or compartment 14 takes up a significant portion of the front cover 100A of the greeting card body. The area of the front cover 100A of the greeting card 100 beneath the enclosed cavity or compartment 14 may be printed or decorated differently than the remaining portion of the front cover 100A of the greeting card 100 which lies outside of the enclosed cavity or compartment 14. For example, the front cover 100A of the greeting card 100 above and around the enclosed cavity or compartment 14 may contain printed sentiment, such as "Get Down" or "Go Wild" printed thereon, as shown in FIG. 1. In the area below and within the enclosed cavity or compartment 14 may have printing thereon which resembles or depicts a dance floor with lights, etc. in the background.

Directly below the enclosed cavity or compartment 14 is a rectangular box or enclosure 16 which extends, in a preferred embodiment, from the bottom horizontal perimeter of the enclosed cavity or compartment 14 down to the bottom edge of the greeting card 100 and also across to cover the entire width of the greeting card 100 (from the fold line to the right side edge of the front cover). The box or enclosure 16 contains the electronic components of the greeting card. The electronic components may include, but are not limited to: a circuit board 18, an integrated circuit chip, a speaker 20, a memory storage device with at least one audio file saved thereon, a power source 22 and any other electronic component which is required or which facilitates audio storage and playback or any other special effect such as lighting or motor movement. Also contained within the box or enclosure 16 is a movement mechanism which effects movement of the articulated character 10 by user manipulation of a push button 12 or other interactive apparatus, such as, for example, a lever, a crank, a slide switch or lever, or other such mechanical device. In a preferred embodiment, the movement mechanism contains a push button 12 which is attached, along a top surface thereof, to a spring 20 and also to at least one (preferably two) strings 22A, 22B. The strings 22A, 22B are also attached, at an opposite end, to the articulated character 10. Pushing the button 12 in an upward direction compresses the spring 20 causing slack in the strings 22A, 22B, thereby causing movement of the articulated character 10. A small lever 24 is also connected or attached to the movement mechanism such that when the button 12 is pushed in an upward direction, it moves the lever 24, which triggers the sound module to replay the at least one audio file through the speaker 20. Small pieces of foam or other material may be placed between and/or around some or all of the electronic components and movement mechanism and around the perimeter edges of the box or enclosure 16 to both protect these components but also to create the consistent rectangular and planar shape of the box or enclosure 16. The entire foam construct with internal components and movement mechanism (or at least the front surface and perimeter surfaces which are visible to the user) is covered by a multi-panel paperboard (or other such material) cover. The cover conceals the inner electronic components and movement mechanism from the user and also creates a more consistent and pleasing appearance of the greeting card 100. A small portion of the lower perimeter edge of the box or enclosure, directly over the lower portion of the movement mechanism (push button portion) is cut out so that the push button 12 is visible and accessible through the multi-panel cover over the box or enclosure 16.

The articulated character 10 is made up of several separate but connected segments which are attached via the at least one (preferably two) strings 22L, 22R which are connected to the movement mechanism, as described above. The center or body portion of the articulated character is a square plastic box 10A. The plastic box 10A contains grooves or channels which allow the two strings 22L, 22R to enter the box 10A from a bottom edge or surface thereof, extend upward in a vertical direction and exit the box 10A in a horizontal manner in each of the right and left perimeter sides of the box 10A (one string goes out the right side and the other string goes out the left side). The box 10A also contains a spring 10B which extends vertically outward from a top surface of the box 10A and is attached (either directly or via an attachment mechanism) to a die cut shape 10C (or other ornament) which depicts the head or face of the character. The arms and legs of the articulated character are each made up of at least two dowels or rods 26L, 26R, 27L, 27R which have an opening therethrough (from vertical top to bottom) into which the strings 22L, 22R are inserted. For example, in the preferred embodiment, the feet or lower portion of each of the character's legs are a first pair of rods 26L, 26R (one rod for the right leg and one rod for the left leg), the first pair of rods 26L, 26R having die cut shapes 28L, 28R attached to the front-facing surface thereof which resemble or depict the character's shoes. A second pair of rods 27L, 27R are connected vertically upward therefrom, the second pair of rods 27L, 27R representing the character's legs (one rod for the right leg and one rod for the left leg). The strings 22L, 22R then extend upward through the plastic box 10A representing the body of the character. As described above, the strings 22L, 22R run vertically upward through two parallel channels inside the plastic box 10A and then exit the plastic box 10B through an opening on each opposing side of the box 10A (one string exiting left and the other string exiting right). The strings 22L, 22R then enter a third and fourth pair of rods 29L, 29R, 30L, 30R (two rods making up a right arm and right hand and two rods making up a left arm and left hand) which extend outward from each side of the box 10A in opposing horizontal directions. The third and fourth pair of rods 29L, 29R, 30L, 30R represent the character's arms and hands. Two die cuts shapes 31L, 31R are attached to the distal ends of the fourth pair of rods 30L, 30R which resemble or depict the character's hands. Therefore, a first end of the two strings 22L, 22R are attached or anchored to the movement mechanism (push button 12). Both strings 22L 22R extend upward in a vertical direction and into and through the first and second pair of rods 26L, 26R, 27L, 27R (which represent the legs and feet of the character) upon which they enter the plastic box 10A representing the character's body from a lower surface thereof and continue to extend vertically upward through two parallel channels within the plastic box 10A and each string exits the plastic box 10A in a horizontal manner, one string 22R exiting from the right side of the box 10A and the other string 22L exiting through the left side of the box 10A. From there the strings 22L, 22R are each inserted into and through the third pair of rods 29L (representing the character's arms) and then enter and terminate within the fourth pair of rods 30L, 30R (representing the character's hands). The character 10 is then able to bend or flex at each of the points between the first 28L, 28R and second pair 29L, 29R of rods, between the second pair 29L, 29R of rods and the plastic box 10A, between the plastic box 10A and the third pair of rods 29L, 29R and between the third 29L, 29R and fourth 30L, 30R rods. Also, when the plastic box 10A (or body of the character) moves it also causes movement of the spring 10B to which the die cut shape 10C representing the character's head is attached.

Figure 2:
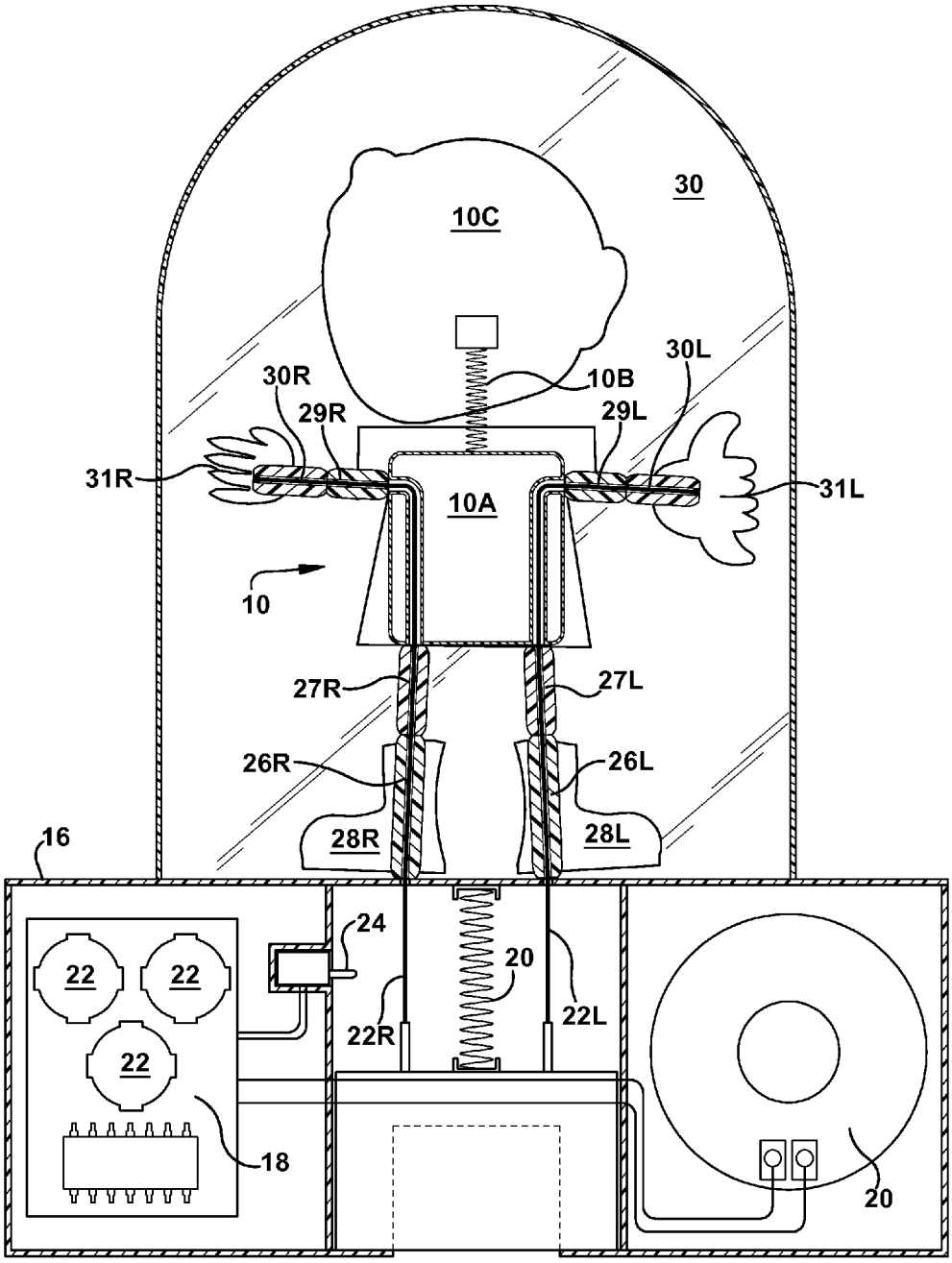
FIG. 2 is a front rear view of a portion of the greeting card of FIG. 1.
Figure 3:
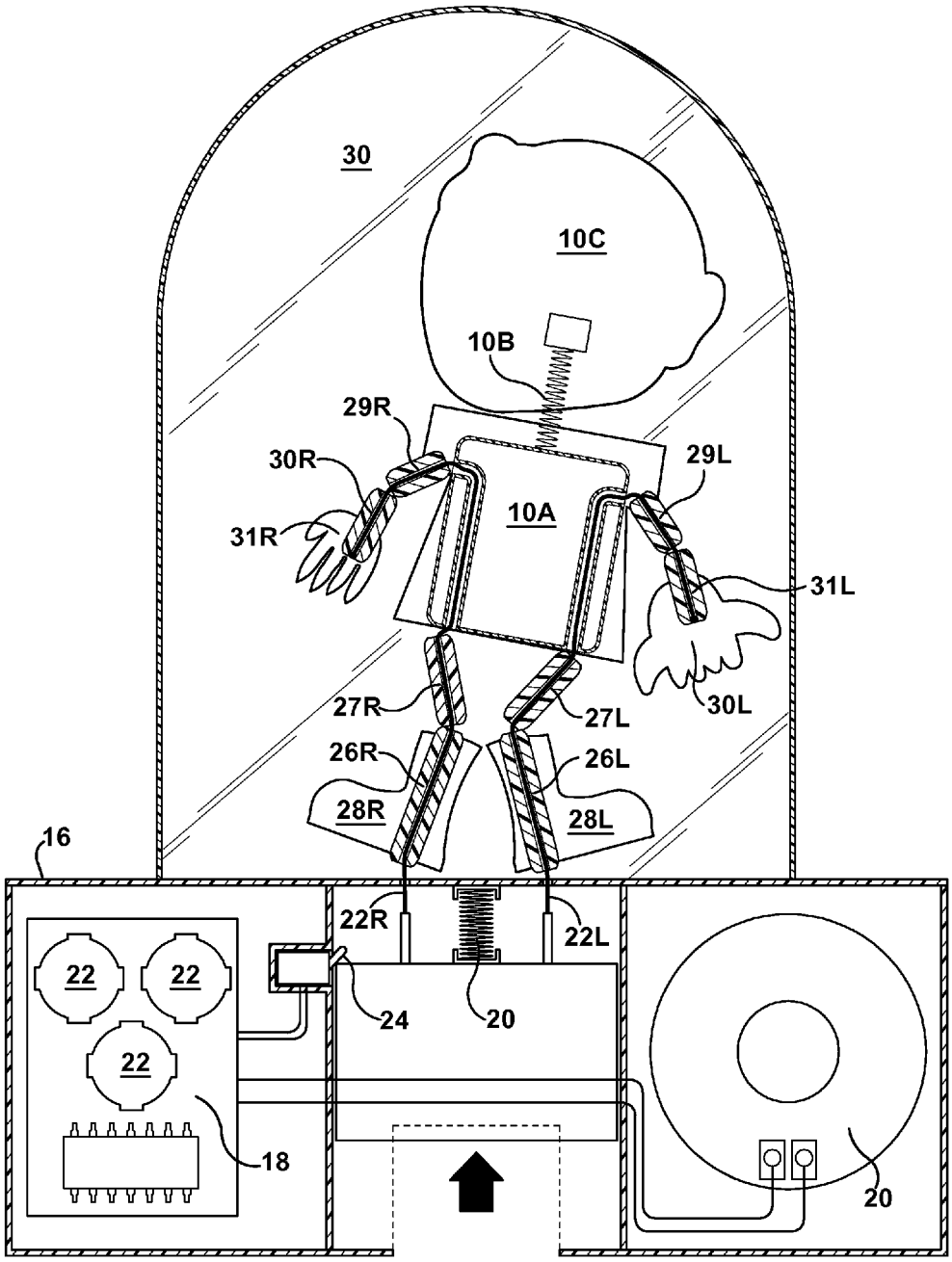
FIG. 3 is a front rear view of a portion of the greeting card of FIG. 1, with depressed push button.

In operation, before the user pushes upward on the push button 12, the articulated character 10 is in a static or non-moving position, as shown in FIG. 2. When the user first pushes upward on the push button 12, the audio begins to play through the speaker 20. Pushing the push button 12 also temporarily loosens the slack of the two strings 22L, 22R causing the articulated character 10 to collapse or bend along one or more of the pivot or hinge points, as shown in FIG. 3. Continuously pushing up on the push button 12 moves the character 10 in different directions which simulate the character 10 dancing to the music being played in the background. The audio file will begin playback upon first pushing the push button 12. The user can continue to push the button 12 in order to move the articulated character 10 while the audio plays in the background. The audio will cease to play when the audio clip runs out. Once the audio has stopped, the user may again press the push button 12 to reinitiate audio playback.

In an alternate embodiment, the enclosed cavity or enclosure with user manipulated articulated character and audio capability can be placed onto a gift bag or gift box in place of a greeting card. The enclosure may be attached to an outer face of a gift bag or on the top surface of a gift box. The press-button described above with respect to the greeting card embodiment may be used or other user-interactive triggers and/or movement mechanisms may be used, such as a horizontal push button, slider, lever, crank, or any other such device.

The greeting card or gift bag may additionally contain one or more lights. The one or more lights may be placed inside the enclosed cavity or compartment 14 or on the greeting card 100 outside of the enclosed cavity or compartment 14. The lights may be illuminated upon the user pushing up on the push button 12 or by a different user-manipulated mechanism, such as a slide switch (lights illuminated when opening the greeting card), a motion sensor or touch sensor (lights illuminated when user picks up or moves the greeting card), a tilt switch (lights illuminated when user moves or tilts the card at a specific angle), a touch sensitive switch plate (lights illuminated when the user touches a certain area of the greeting card), or other such switch mechanisms.

While the greeting card has been described herein as having two panels, the card may have a single panel, at least two panels, two or more panels, or any number of greeting card panels. The greeting card and enclosed cavity or compartment have been described as having a particular shape and size, however, different shapes and sizes have been contemplated and are considered to fall under the scope of the present invention. The articulated character has been described, with respect to a preferred embodiment, as having a certain number of rods or dowels and pivot points, however, other configurations and number of pieces which make up the articulated character are also considered to fall under the scope of the present invention. As long as the character can bend or move about at least one hinge or pivot upon user interaction with the greeting card, it captures the spirit in which the invention was created and developed. The articulated character is also described herein as having die cut shapes attached thereto which represent various parts of the character, such as a head, hands, body, shoes, pants, shirt, etc., however, other means can be used to represent these aspects of the character. Specific materials described herein are mentioned as an example or as the preferred embodiment of the invention and does not preclude other materials from being used in addition to or in place of materials mentioned herein.

The invention claimed is:

1. A greeting card comprising:

a greeting card body having at least one panel;

an articulated character having at least one hinge or pivot point contained thereon about which the character can bend or move, the articulated character located between the at least one panel of the greeting card body and a transparent cover which is attached to the at least one panel of the greeting card body;

a push button attached to the articulated character;

wherein pushing upward on the push button causes movement of the articulated character and said movement is generated upward from below the articulated character.

2. The greeting card of claim 1, wherein the articulated character is comprised of a plurality of dowels or rods attached via at least one string.

3. The greeting card of claim 1, wherein the articulated character is comprised of a plurality of dowels or rods which are connected to the push button via at least one strings.

4. The greeting card of claim 1 further comprising a sound module operative to store and playback at least one audio file.

5. The greeting card of claim 4, wherein the push button controls activation of the sound module wherein pressing the push button triggers playback of the at least one audio file.

6. The greeting card of claim 1, wherein continuously pushing the push button causes the articulated character to move or bend in different directions.

7. The greeting card of claim 2, wherein continuously pushing the push button causes movement of the articulated character by compressing and releasing a spring which causes the at least one string to move between a taut state and a slackened state.

8. A greeting card comprising:

at least one greeting card panel;

a jointed character attached to the at least one greeting card panel, the jointed character comprising two or more adjacent rods attached via at least one string;

a user-interactive movement device located below the jointed character;

a sound module operative to store and playback at least one audio file;

a lever operative to move between a first position and a second position;

wherein pushing upward on the user-interactive movement device causes the jointed character to bend or move at a point between the two or more adjacent rods and also moves the lever from the first position to the second position thereby initiating playback of the at least one audio file.

9. The greeting card of claim 8 further comprising a spring extending upward from a top surface of the jointed character, the spring having a die cut shape attached thereto.

10. The greeting card of claim 8, wherein the user-interactive movement device is only capable of moving upward in a uniform manner.

11. The greeting card of claim 8 further comprising a transparent cover over the jointed character.

12. The greeting card of claim 8, wherein the user-interactive movement device is a push button.

13. The greeting card of claim 8, wherein the push button is attached to a spring which is compressed when the push button is pushed, causing movement of the jointed character.

14. The greeting card of claim 8 further comprising one or more die cut shapes attached to the two or more adjacent rods.

15. A greeting card comprising:

at least one greeting card panel;

a moveable character comprising a body portion, at least two pairs of dowels which are each independently connected to a push button mechanism via a string, and a head portion which is attached to an upper surface of the body portion via a coiled spring which extends upward in a vertical direction from the upper surface of the body portion;

the push button mechanism having a spring attached thereto wherein pushing the push button compresses the spring, causing slack in the string such that the moveable character bends or pivots about the point between each adjacent dowel in the at least two pairs of dowels and also causing the head portion of the moveable character to bounce on the coiled spring.

16. The greeting card of claim 15 further comprising a sound module operative to store and playback at least one audio file.

17. The greeting card of claim 16, wherein the push button mechanism also serves as a trigger to initiate playback of the at least one audio file.

18. The greeting card of claim 16 further comprising a transparent cavity which enclose the moveable character therein.

19. The greeting card of claim 16, wherein the head portion of the moveable character is die cut.

20. The greeting card of claim 16 wherein the moveable character contains two dowels representing a right leg, two dowels representing a left leg, two dowels representing a right arm and two dowels representing a left arm.

* * * * *